US006150318A

United States Patent [19]

Silvester et al.

[11] Patent Number: 6,150,318

[45] **Date of Patent: *Nov. 21, 2000**

[54] AEROSOL CLEANING COMPOSITIONS

[75] Inventors: Raymond Neville Silvester, Castle Hill; Boris Frank Cvetko, Austral, both of Australia

[73] Assignee: Reckitt Benckiser Australia Limited, Erminton, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/669,584

[22] Filed: Jun. 24, 1996

[30] Foreign Application Priority Data

Jun. 23, 1995 [GB] United Kingdom ..... 9512900

[51] Int. Cl.[7] ..... D06L 17/04; C11D 17/00; C11D 17/08

[52] U.S. Cl. ..... 510/284; 510/283; 510/365; 510/406; 510/417

[58] Field of Search ..... 510/417, 406, 510/365, 197, 279, 283, 284; 424/70.24, 47

[56] References Cited

U.S. PATENT DOCUMENTS

| | | | |
|---|---|---|---|
| 3,354,088 | 11/1967 | Elmquist | 252/90 |
| 3,929,492 | 12/1975 | Chapman et al. | 106/3 |
| 3,947,567 | 3/1976 | Berg, Jr. et al. | 424/45 |
| 3,955,986 | 5/1976 | Miller | 106/11 |
| 4,362,638 | 12/1982 | Caskey et al. | 252/90 |
| 4,439,343 | 3/1984 | Albanese | 252/305 |
| 4,574,052 | 3/1986 | Gupte et al. | 252/90 |
| 4,880,557 | 11/1989 | Ohara et al. | 252/174.15 |
| 4,954,286 | 9/1990 | Sepulveda et al. | 252/174.22 |
| 5,227,085 | 7/1993 | Motsenbocker | 252/99 |
| 5,399,282 | 3/1995 | Hansen et al. | 252/162 |
| 5,523,014 | 6/1996 | Dolan et al. | 252/122 |
| 5,597,792 | 1/1997 | Klier et al. | 510/417 |
| 5,616,548 | 4/1997 | Thomas et al. | 510/242 |

FOREIGN PATENT DOCUMENTS

| | | |
|---|---|---|
| 0 559 472 A1 | 9/1993 | European Pat. Off. . |
| 1384267 | 2/1975 | United Kingdom . |
| WO 90/05774 | 5/1990 | WIPO . |
| WO 90/11343 | 10/1990 | WIPO . |
| WO 92/16188 | 10/1992 | WIPO . |
| WO 92/21238 | 12/1992 | WIPO . |

OTHER PUBLICATIONS

Copy of an EP Search Report for EP application No. 96 91 8509 dated Aug. 2, 1999.

*Primary Examiner*—Necholus Ogden
*Assistant Examiner*—Gregory E. Webb
*Attorney, Agent, or Firm*—Fish & Richardson P.C.

[57] ABSTRACT

A cleaning composition being an oil-in-water emulsion in aerosol form characterized in that sufficient of the propellant is retained in the emulsion on discharge to a surface such that the retained propellant boils to create a sustained bubbling action in the absence of foaming on the surface. The cleaning composition comprises an oil-in-water emulsion containing (a) 2 to 60% w/w in total amount of one or more hydrocarbon propellants such that the propellants substantially form a part of the oil phase when the composition is formulated; (b) 2 to 50% w/w in total amount of one or more surfactants; (c) 0.1 to 30% w/w in total amount of one or more water-immiscible organic compounds; (d) 0.5 to 40% w/w in total amount of one or more water-miscible organic coupling agents; and (e) 10 to 70% w/w of water.

24 Claims, No Drawings

AEROSOL CLEANING COMPOSITIONS

TECHNICAL FIELD

This invention relates to cleaning compositions and in particular to compositions in aerosol form that are useful in cleaning a wide range of surface types including textiles such as clothing, fabrics and carpets and hard surfaces such as glass, metal, ceramics, porcelain, synthetic plastics and vitreous enamel.

BACKGROUND OF THE INVENTION

The prior art is replete with a variety of aerosol compositions for use in cleaning many surface types. Basically, these compositions may be divided into two groups, namely those that are solvent-based and those that are water-based. Both of these groups suffer from shortcomings which desirably should be overcome or at least improved.

In the case of solvent-based compositions, the prime concerns are environmental and undesirable solvent odour.

In the case of water-based compositions, the prime concern is cleaning performance, particularly in relation to grease, wax and oil-based soils.

It would therefore be an advance in the art to be able to provide a water-based composition with enhanced cleaning performance, desirably with a grease, wax and oil-based soil cleaning performance akin to the solvent-based compositions.

The present inventors have surprisingly found that one way of meeting this performance requirement for a water-based composition occurs when certain oil-in-water emulsions are formed. These emulsions are characterised by a substantial proportion or all of the aerosol propellant forming a part of the oil-phase when the composition is fully formulated.

BRIEF SUMMARY OF THE INVENTION

Accordingly, the present invention consists in a cleaning composition comprising in aerosol form an oil-in-water emulsion containing:

(a) one or more hydrocarbon propellants in a total amount of from 2 to 60% w/w, wherein the propellants substantially form a part of the oil phase when the composition is formulated;

(b) one or more surfactants in a total amount of from 2 to 50% w/w;

(c) one or more water-immiscible organic compounds in a total amount of from 0.1 to 30% w/w;

(d) one or more water-miscible organic coupling agents in a total amount of from 0.5 to 40% w/w; and (e) water in an amount of from 10% w/w to 70% w/w;

characterised in that sufficient of the propellant is retained in the emulsion on discharge to a surface such that the retained propellant boils to create a sustained bubbling action in the absence of foaming on the surface.

As used in this specification, all percentages are w/w with respect to the active material, unless otherwise indicated.

DETAILED DESCRIPTION OF THE INVENTION

It is believed that the cleaning performance of the compositions of this invention derives from at least two factors. Firstly the solvent action of the propellant retained in the oil phase when the composition on discharge contacts the soil. Secondly, the physical agitation caused by the propellant in the oil phase boiling off to the atmosphere. This is the belief of the inventors, although it will be appreciated that in considering the nature of this invention, this belief is non-binding and should not in any way be construed as a limitation of the scope of the invention.

The boiling off of the propellant from the surface onto which a composition of the invention is discharged is characterised by a bubbling action on the surface. This bubbling action could also be described as "sizzling". In general terms the bubbles are fast breaking and do not persist to create a foam.

The bubbling action is sustained, being generally characterised by an initial vigorous action for up to about 15 seconds then a continuous, less vigorous phase for up to 1 minute or more.

It is, however, preferred that no or minimal amounts of foam are formed. In this way, it will be readily apparent to a consumer using a composition of the invention that cleaning is occurring as the bubbling action will be visually apparent.

Desirably, the compositions on discharge will be further characterised presenting as a wet spray in appearance. In this form the composition "wets out" the stain.

The bubbling action contributes significantly to the broad spectrum cleaning performance of the compositions of the invention by providing a physical lifting action. In particular, in the compositions of the invention, the retained propellant is released in the form of bubbles which relatively quickly break releasing propellant to the atmosphere. The sustained nature of this bubbling action provides a prolonged cleaning action.

It is important to note that compositions in the prior art do not display the sustained bubbling action on account of the propellant rapidly flashing off to the atmosphere.

The compositions of the present invention are water-based although it is evident that their cleaning performance is equivalent to or exceeds solvent-based compositions. This is indeed surprising in view of prior art water-based compositions.

Nature of the Emulsion

In the compositions of the invention a concentrate which includes (b), (c), (d) and (e) will be formed. Propellant is added to this concentrate to create compositions of the invention.

Prior to the addition of propellant, the concentration desirably is a stable oil-in-water emulsion, preferably a substantially clear microemulsion.

It is, however, within the scope of the invention to utilise a concentrate that is not a fully stable or clear oil-in-water emulsion. For emulsions of this type, it is a requirement that upon addition of propellant, an oil-in-water emulsion is formed such that sufficient of the propellant is retained in the emulsion on discharge to a surface so that the retained propellant boils to create a bubbling action on the surface. Such an emulsion may be clear or characterised by a slight haziness through to a milky liquid to the presence of some separate oil layer.

In the fully formulated compositions of the invention, ie when the propellant is added to the concentrate, it is preferred that substantially all of the propellant is taken up in the oil-phase to form an oil-in-water emulsion. This emulsion is desirably a stable clear microemulsion. Emulsions with some separate oil phase, however, are acceptable providing that the separate oil phase portion re-emulsifies on shaking and sufficient of the propellant is retained in the emulsion on discharge to a surface such that the retained propellant boils to create a bubbling action on the surface.

(a) Propellant

One or more hydrocarbon propellants are used in the compositions of the invention in a total amount from 2 to 60% w/w. Amongst the hydrocarbon propellants that may be used are acetylene, methane, ethane, ethylene, propane, propene, n-butane, n-butene, iso-butane, iso-butene, pentane, pentene, iso-pentane and iso-pentene. Mixtures of these propellants may also be used.

Indeed, it should be noted that commercially available propellants typically contain a number of hydrocarbon gases. For example, unodourised commercial butane (available from Boral Gas) contains predominantly n-butane and some iso-butane along with small amounts of propane, propene, pentane and butene.

Preferred propellants include propane, n-butane, iso-butane, pentane and iso-pentane, whilst most preferred are propane, n-butane and iso-butane.

Broadly, the concentration of propellant will be from 2 to 60% w/w, generally the concentration will be from 5 to 50% w/w; preferably from 10 to 30% w/w.

Particularly preferred are mixtures of propane, n-butane and iso-butane.

The person skilled in the art will appreciate that the pressure in an aerosol package will be determined by the propellant or mixture of propellants. This pressure will have a determining effect on spray rate. Hence for any particular valve system, varying the propellant or propellant mixture will allow for the selection of a desired spray rate.

Likewise, for a particular propellant or propellant mixture, it is possible to select a valve and actuator system to achieve a desired rate.

As previously mentioned, sufficient of the propellant must be retained in the emulsion on discharge so to create the boiling action. It has been found that approximately 4 to 6% w/w of propellant may be retained in the emulsion immediately after discharge onto a surface. It must be appreciated, however, that the amount of retained propellant is difficult to measure accurately. The amount recited is therefore for guidance only. The bubbling action is nevertheless an important characteristic of the composition of the invention. In use on oils such as dirty sump oil stains, it is visually evident that the bubbling action actually lifts the stain away from a fabric surface.

(b) Surfactants

One or more surfactants are included in a total amount of from 2 to 50% w/w, preferably from 5 to 25% w/w. Either nonionic, amphoteric, anionic or cationic surfactants may be used, although nonionic and/or anionic surfactants are preferred. The surfactants function primarily in the formation of the emulsion. Desirably, the surfactants also contribute to cleaning.

When more than one surfactant is used, an individual surfactant component may be in a concentration as low as 0.1 to 5.0% w/w. For example, sodium lauroyl sarcosinate may be used in a concentration of 0.2% w/w as a corrosion inhibitor. In a further example, Surfadone LP300 in a concentration of 0.5% w/w may be used to improve wetting and stain removal. They will, however, participate in the oil-in-water emulsion.

Examples of surfactants that may be used are as follows:

Nonionic surfactants—sorbitan fatty acid ester ethoxylates, glycerol fatty acid ester ethoxylates, sorbitan fatty acid esters, glycerol fatty acid esters, coconut monoethanolamide ethoxylates, tall oil ethoxylates, polypropylene glycol ethoxylates, fatty acid alkanolamides such as coconut mono- and diethanolamide, fatty alcohol ethoxylates and propoxylates, amine oxides, n-alkyl pyrrolidones, alkyl polysaccharides such as sucrose esters and alkyl polyglycosides, alkyl phenol ethoxylates, ethoxylated castor oil, fatty acid ethoxylates, fatty amine ethoxylates, polyglycerol fatty acid esters.

Anionic surfactants—sodium lauryl ether sulfate, triethanolamine lauryl sulphate, magnesium lauryl sulfate, sulfosuccinate esters, ammonium lauryl sulfate, alkyl sulfonates, sodium lauryl sulfate, sodium alpha olefin sulfonates, alkyl sulfates, sulfated alcohol ethoxylates, sulfated alkyl phenol ethoxylates, sodium xylene sulfonate, alkylbenzene sulphonates such as triethanolamine dodecylbenzene sulfonate, sodium dodecylbenzene sulfonate, calcium dodecylbenzene sulfonate, xylene sulfonic acid, dodecylbenzene sulfonic acid, N-alkoyl sarcosinates such as sodium lauroyl sarcosinate, dialkylsulfosuccinates, N-alkoyl sarcosines such as lauroyl sarcosine, alkyl ether carboxylates, soaps including sodium, potassium, magnesium, calcium, alkanolamine and amine soaps.

Amphoteric surfactants—betaines, n-alkyl pyrrolidones (because it has a resonance structure, it may behave as a zwitterionic substance), imidazolines.

Cationic surfactants—quaternary ammonium compounds including alkyl dimethyl benzyl ammonium chloride, dialkyl dimethyl ammonium chloride, alkyl trimethyl ammonium chloride or bromide, salts of organic or inorganic acids with fatty amines and fatty amine ethoxylates.

Mixtures of surfactants types may be used such as nonionic and anionic surfactants. A proprietary mixture of this type is Monamulse DL 1273 available from Mona Industries, Inc.

(c) Water-Immiscible Organic Compound

The primary function of this compound is to suppress the generation of foam on discharge of the aerosol. Such a property, as previously explained, is important to the performance of the compositions of the invention, since what is required is a bubbling action on the surface, rather than a foam.

Preferred water immiscible organic compounds, however, will usually have a secondary cleaning functionality through their solvency properties.

One or more water immiscible organic compounds are included in the composition in a total amount from 0.1 to 30% w/w, preferably 0.5% to 30% w/w, most preferably 2% w/w to 20% w/w.

In the lower end of the concentration range, silicone antifoams may be used such as Dow Corning Antifoam A.

Examples of water immiscible organic compounds include—liquid n-paraffins, liquid iso-paraffins, cycloalkanes, naphthene-containing solvents, white spirit, kerosene, aromatic solvents, mineral turpentine, ester solvents, silicone solvents or oils, terpenes, fatty acids, paraffin waxes, linear alkyl benzene, dialkyl phthalates, $C_5$–$C_{11}$ alcohols and fatty alcohols. Specific examples of these are as follows:

liquid n-paraffins—Norpar 12, Norpar 13 and Norpar 15 (available from Exxon)

liquid iso-paraffins—Isopar G, Isopar H, Isopar L, Isopar M and Isopar V (available from Exxon)

naphthene-containing solvents—Exxsol D40, Exxsol D60, Exxsol D80, Nappar 10 (available from Exxon)

ester solvents—such as alkyl acetates, examples being Exxate 1000, Exxate 1300 (available from Exxon), and Coasol (available from Chemoxy International).

silicone solvents or oils—Dow Corning 244, 245, 344 and 345 fluids.

terpenes—eucalyptus oil, cineole, orange oil, limonene.

fatty amines—soya amines, tallow amines, cocoamines.

fatty acids—caprylic acid, caproic acid, capric acid, lauric acid, myristic acid, palmitic acid, stearic acid, behenic acid, oleic acid.

fatty alcohols—octanol, decanol, lauryl alcohol, myristyl alcohol, cetyl alcohol, stearyl alcohol, cetostearyl alcohol, oleyl alcohol.

aromatic solvents—toluene, benzene, xylene.

Preferred water immiscible organic compounds are liquids at room temperature. Particularly preferred are hydrocarbon solvents, especially those that are good grease solvents. Most preferred are hydrocarbon solvents having a low solvent odour such as n-paraffins and iso-paraffins.

(d) Water-Miscible Organic Coupling Agent

One or more water miscible organic coupling agents are included in a total amount of from 0.5 to 40% w/w, preferably 5 to 30% w/w.

The coupling agent primarily functions to couple the propellant to the water and the water immiscible organic compound to the water. This assists in the formation of the emulsion and the retention of the propellant after discharge of compositions of the invention. The coupling agent also functions to couple the surfactant to the water, so as to prevent insolubility and/or gelling when it occurs.

A secondary function is to provide some solvency for cleaning.

Amongst the compounds that may be used are:

low molecular weight alcohols such as methanol, ethanol, n-propanol, iso-propanol, n-butanol and iso-butanol;

glycol ethers such as ethylene glycol monobutyl ether, dipropylene glycol monomethyl ether, propylene glycol monomethyl ether and diethylene glycol monobutyl ether;

glycols such as propylene glycol, hexylene glycol and ethylene glycol;

polyglycols such as PEG200 and PEG6000;

polypropylene glycols;

polyols such as glycerol, sorbitol, pentaerythritol and mannitol;

low molecular weight ketones such as acetone; and

N-methyl pyrrolidone.

Preferred are the low molecular weight alcohols, particularly ethanol or iso-propanol, most preferred is ethanol.

(e) Water

The water is included in the compositions of the invention in an amount of from 10 to 70% w/w, preferably 25 to 55% w/w.

Desirably the water is purified before use and may be deionised or distilled.

In addition to the essential components (a) to (e), a range of optional components may be included. The inclusion of the components may be specific to a particular composition type or may be to meet a particular compositional need or consumer requirement.

(f) Optional Components (i) Surfactant additives—These may be included to enhance cleaning and washout performance. Examples include good wetting agents, dispersing agents and the like. Specific examples include Surfadone LP 300 (n-dodecyl-2-pyrrolidone available from ISP) and Surfadone LP 100 (n-octyl-2-pyrrolidone); as good wetting agents, sodium lauryl ether sulphate as a dispersing agent for inorganic soil.

(ii) Alkaline builder salts such as sodium carbonate, sodium sesquicarbonate, sodium tripolyphosphate, tetrasodium pyrophosphate, tetrapotassium pyrophosphate, zeolites, sodium hexametaphosphate.

(iii) Sequestering, complexing agents or water softening agents such as EDTA and its salts, sodium citrate, sodium gluconate, sodium glucoheptonate, phosphonates, DTPA and its salts, NTA and its salts.

(iv) pH control, buffering or adjusting agents such as sodium bicarbonate, ammonium bicarbonate.

(v) Perfumes.

(vi) Dyes.

(vii) Preservatives.

(viii) Soil suspending or anti-redepositing agents.

(ix) Soil release or anti-resoiling agents such as Zonyl 7950, Zelan 338 (available from Dupont), Repel-o-Tex QCJ and QCX (available from Rhone-Poulenc).

(x) Corrosion inhibitors such as sodium lauroyl sarcosinate, AMP regular, sodium nitrite, QAI 50%—2 hydroxy propamine nitrite (available from Enviro Systems USA).

(xi) Co-surfactants (water immiscible coupling agents)—including $C_5$–$C_{16}$ alcohols.

(xii) Organic and/or inorganic acids—particularly in use for compositions of the invention which are toilet cleaners. Such compositions will usually require the use of synthetic plastic aerosol containers.

(xiii) Thickening agents—particularly to retard release of propellant from the bubbling surface. Many also be used for particular compositional requirements such as toilet cleaners to retain composition on angular surfaces.

(xiv) Abrasives—particularly for hard surface cleaning compositions. An abrasive may be deposited from the composition and mechanically agitated to provide additional cleaning. Compounds such as fumed silica may be used.

(xv) Alkaline compounds—particularly for hard surfaces and including ammonia, amines, such as mono-, di-, and triethanolamine, morpholine and AMP regular.

(xvi) Antimicrobials—including disinfectant, antibacterial and germicidal compounds.

(xvii) Enzymes—including protease, amylase, lipase and cellulase.

(xviii) Hydrotropes—such as urea.

(xix) Solvents for specific soils—such as ethanol, isopropanol, glycol ethers, N-methylpyrrolidone, white spirit, kerosene, n-paraffins, iso-paraffins, naphthene-containing solvents, ester solvents, terpenes, cycloalkanes, hydrofluorocarbon solvents.

(xx) Chlorine, oxygen or reducing bleaching substances—such as hypochlorite, peroxygen compounds, sodium dithionite (sodium hydrosulfite) and sodium metabisulfite for use in bleachable stain removal. Such compositions will usually require the use of synthetic plastic aerosol containers.

(xxi) Supplementary propellants such as dimethyl ether and hydrofluorocarbons.

The pH of the compositions is not critical and as mentioned previously, a toilet cleaning composition may have a very low pH, typically 1 or less. Similarly, some hard surface cleaning compositions may have a very high pH such as 13 or above.

For other cleaning purposes, the pH may be in the range of from 7 up to 11.5.

The compositions of the invention may be prepared in the form of a variety of cleaning compositions including textile cleaners, such as carpet cleaners and prewash cleaners; hard surface cleaners for uses such as toilets, tiles, glass, stainless steel, ovens, kitchen, bathroom surfaces; paint strippers and mildew removers.

Manufacture

To produce compositions of the invention a concentrate is formed by dissolving the water phase ingredients and then adding the oil phase ingredients with stirring. In some circumstances heating may be required. This concentrate is then filled into aerosol packages and gassed with propellant in a conventional manner.

EXAMPLES

In order to better understand the nature of the invention, the following examples, which illustrate prewash cleaning compositions, were prepared.

Note that essential components are according to the definition on page 2.

Example 1

| Ingredient | % w/w |
|---|---|
| (b) Crillet 45 | 3.30 |
| (b) Monamulse DL 1273 | 3.30 |
| (b) Surfadone LP 300 | 5.50 |
| (d) Denatured Absolute Ethanol 100 AG/F3 | 15.40 |
| (c) Norpar 15 | 5.50 |
| (e) Deionised water | 44.10 |
| (a) Butane | 16.95 |
| (a) Proprane | 5.95 |
| | 100.00 |

Example 2

| Ingredient | % w/w |
|---|---|
| (b) Teric LA4 | 11.90 |
| (b) Teric G12A6 | 1.15 |
| Surfadone LF300 | 0.50 |
| (c) Norpar 12 | 9.35 |
| (d) Denatured Absolute Ethanol 100 AG/F3 | 15.00 |
| Light Soda Ash | 0.10 |
| Sodium Bicarbonate (standard grade) | 0.05 |
| Sodium citrate | 0.10 |
| Perfume | 0.20 |
| Sodium Lauroyl Sarcosinate (30% active) | 0.70 |
| AMP Regular | 0.20 |
| (e) Deionised water | 40.35 |
| (a) Butane | 15.10 |
| (a) Propane | 5.30 |
| | 100.00 |

The pH of this example was about 11 and pressure about 65–68 psi at 25° C.

Example 3

| Ingredient | % w/w |
|---|---|
| (b) Teric LA4 | 10.90 |
| (b) Teric G12A6 | 2.05 |
| Surfadone LP300 | 0.50 |
| (c) Norpar 12 | 9.35 |
| (d) Denatured Absolute Ethanol 100 AG/F3 | 15.00 |
| Light Soda Ash | 0.10 |
| Sodium Bicarbonate (standard grade) | 0.05 |
| Sodium Citrate | 0.10 |
| Perfume | 0.20 |
| Sodium Nitrite | 0.20 |
| (e) Deionised Water | 41.15 |

-continued

| Ingredient | % w/w |
|---|---|
| (a) Butane | 15.10 |
| (a) Propane | 5.30 |
| | 100.00 |

The pH of this example was about 11 and pressure about 65–68 psi at 25° C.

Example 4

| Ingredient | % w/w |
|---|---|
| (b) Teric LA4 | 10.73 |
| (b) Teric G12A6 | 2.25 |
| Surfadone LP300 | 0.50 |
| (c) Norpar 12 | 9.35 |
| (d) Denatured Absolute Ethanol 100 AG/F3 | 15.00 |
| Light Soda Ash | 0.10 |
| Sodium Bicarbonate (standard grade) | 0.05 |
| Sodium Citrate | 0.10 |
| Perfume | 0.20 |
| Sodium Nitrite | 0.20 |
| (e) Deionised Water | 41.15 |
| (a) Butane | 17.14 |
| (a) Propane | 3.26 |
| | 100.00 |

The pH of this example was about 11 and pressure about 50–51 psi at 25° C.

Example 5

| Ingredient | % w/w |
|---|---|
| (b) Teric LA4 | 9.40 |
| (b) Teric G12A6 | 3.40 |
| Surfadone LP300 | 0.50 |
| (c) Norpar 12 | 9.35 |
| (d) Denatured Absolute Ethanol 100 AG/F3 | 17.00 |
| Light Soda Ash | 0.10 |
| AMP Regular | 0.10 |
| Sodium Citrate | 0.10 |
| DS 1986 | 1.10 |
| Perfume | 0.20 |
| Sodium Lauroyl Sarcosinate (30% active) | 0.35 |
| (e) Deionised Water | 38.00 |
| (a) Butane | 15.10 |
| (a) Propane | 5.30 |
| | 100.00 |

The pH of this example was about 11.5 and pressure about 65–68 psi at 25° C.

Ingredient Availability

AMP Regular—Angus Chemicals (2-amino-2-methyl-propanol)

Crillet 45—Croda (sorbitan trioleate condensed with 20 moles ethylene oxide)

Monamulse DL1273—Mona Industries, Inc (85% active alkanolamides and sulfosuccinate esters)

Surfadone LP300—ISP

Denatured Absolute ethanol—CSR Ltd

Norpar 15—Exxon (mixture of predominantly $C_{13}$–$C_{14}$ n-alkanes)

Norpar 12—Exxon (mixture of predominantly $C_{10}$–$C_{13}$ n-alkanes)

Teric LA4—ICI (straight chain synthetic $C_{12}$–$C_{15}$ alcohol condensates with 4.5 moles of ethylene oxide)

Teric G12A6—ICI (straight chain synthetic $C_{12}$–$C_{15}$ alcohol condensates with 6.0 moles of ethylene oxide DS1986—ICI (Teric 12A series fatty alcohol)

Light Soda Ash—Penrice (Sodium carbonate standard grade)

Sodium Bicarbonate—(Penrice standard grade)

Butane—Boral Gas (unodourised commercial butane)

Propane—Boral Gas (unodourised commercial propane)

Cleaning Performance

The cleaning performance of examples 1 and 5 was evaluated using the following test methodology for prewash products.

1.0 FABRIC

White polyester/cotton 65/35

White cotton 100%

2.0 WASHING CONDITIONS 2.1 Hoover Elite 1025 top loading automatic washing machine, 12 minute wash, 2 rinses.

2.2 Wash temperature: Cold, record actual temperature.

2.3 Detergent: standard commercial powder laundry detergent 1.5 g/L.

2.4 Only test and control swatches are washed in machine, no dummy load.

2.5 Swatches are dried in tumble dryer before evaluation.

3.0 STAINS

Test Stains

Grease and Oil Category

1. Sump Oil (applied to soak 80 mm circle)
2. Engine Grease (applied to soak 50 mm circle)
3. Lipstick (applied over 10×50 mm area)
4. Shoe Polish (dabbed lightly on 25 mm circle)
5.* Synthetic Sebum (heat at 37° C. blue fabric)

Bleachable Category

6. Blue Biro (applied approx over 10×50 mm area)
7. Black Texta (solvent based felt pen applied over 10×50 mm area)
8. Red Wine (applied to soak approx 80 mm circle)

Proteinaceous Category

9. Grass (applied to approx 10×50 mm area)

Fabric swatches are to be washed according to washing conditions given above prior to staining.

Always prepare two sets of stains more than the number of samples to be evaluated and wash one set without prewash treatment (control swatches) and keep the other set unwashed and without prewash treatment as rating standards for no stain removal. Select swatches randomly for samples to be evaluated.

4.0 TIMING

Standard time between staining and prewash application is 24 hours.

4.1 Aerosols and Triggers: apply pre-wash for 1 minute before washing.

4.2 Soaker: Soak for 12 hours before washing.

4.3 Soap: Apply approx 0.5 g to each stain and scrub for approx 30 seconds before washing 5.0 RATING 5.1 Stains are rated on a 0–5 scale 0 indicates complete removal of stain 5 indicates no removal of stain 0.5 units are used in rating 5.2 Stains are rated by n experienced people independently and the ratings averaged for each stain.

5.3 Stains are rated in strong "south" daylight (would be north light in the northern hemisphere). White swatches are laid flat on a dark background for rating, this procedure makes rating easier and more reproducible, especially for oil stains.

6.0 TEST DESIGN 6.1 This varies depending on the aim of the test. Extra parameters such as age of the stain or washing conditions can be varied if necessary.

6.2 An "untreated" control stain is always washed in the same load as each sample tested with prewash. A number of different stains are tested in the same wash load (along with their corresponding "untreated" controls) but only one prewash product is tested in the one washing machine load.

6.3 Wherever possible, ratings are compared only within the one set of trials.

*Synthetic Sebum Formula

| Component | % w/w |
|---|---|
| Palmitic acid | 10.0 |
| Stearic acid | 5.0 |
| Coconut oil | 15.0 |
| Paraffin wax | 10.0 |
| Spermaceti wax | 15.0 |
| Olive oil | 20.0 |
| Squaline | 5.0 |
| Cholesterol | 5.0 |
| Oleic acid | 10.0 |
| Linoleic acid | 5.0 |
| Total | 100.0 |

Results: First Series (n = 3)

| | Prewash Compositions | | | | | | | | |
|---|---|---|---|---|---|---|---|---|---|
| Soil/Fabric | C | N | P | Q | R | S | T | U | Example 1 |
| Engine Grease/Cotton | 5 | 4.83 | 2.83 | 4.67 | 3.00 | 3.00 | 5.00 | 3.17 | 3.33 |
| Lipstick/Cotton | 5 | 3.67 | 3.33 | 2.17 | 3.67 | 3.67 | 2.33 | 2.00 | 2.00 |

-continued

| Results: First Series (n = 3) | | | | | | | | | |
|---|---|---|---|---|---|---|---|---|---|
| | Prewash Compositions | | | | | | | | |
| Soil/Fabric | C | N | P | Q | R | S | T | U | Example 1 |
| Lipstick/ Poly-Cotton | 5 | 3.83 | 2.33 | 3.00 | 3.33 | 3.33 | 2.83 | 2.00 | 1.67 |
| Shoe Polish/Cotton | 5 | 3.50 | 4.00 | 3.33 | 4.00 | 4.33 | 3.67 | 3.00 | 2.17 |
| Shoe Polish/Poly-Cotton | 5 | 3.17 | 3.67 | 2.83 | 3.67 | 4.17 | 3.67 | 3.00 | 2.33 |
| Sebum synthetic/ Cotton | 5 | 1.33 | 0.17 | 2.00 | 0.17 | 0 | 1.83 | 0 | 0 |
| Sebum synthetic/ Poly-cotton | 5 | 1.50 | 0 | 1.17 | 0 | 0 | 1.50 | 0 | 0 |
| Blue Biro/Cotton | 5 | 4.00 | 2.33 | 1.83 | 2.00 | 2.00 | 2.67 | 1.33 | 0.67 |
| Blue Biro/ Poly-cotton | 5 | 4.33 | 3.83 | 3.33 | 2.67 | 3.00 | 4.50 | 2.33 | 2.17 |
| Black Texta/Cotton | 5 | 4.67 | 5.50 | 4.17 | 4.67 | 4.67 | 4.67 | 5.33 | 3.00 |
| Red Wine/Cotton | 5 | 2.00 | 2.17 | 2.67 | 2.67 | 3.17 | 2.83 | 2.50 | 1.83 |
| Red wine/ Poly-cotton | 5 | 1.17 | 1.00 | 1.83 | 2.00 | 2.00 | 2.67 | 1.17 | 1.00 |
| Grass/Cotton | 5 | 3.50 | 4.33 | 3.83 | 3.50 | 3.50 | 3.17 | 3.67 | 2.00 |
| Grass/ Poly-cotton | 5 | 2.63 | 3.00 | 4.00 | 3.50 | 3.00 | 2.50 | 2.83 | 2.50 |

Wash Temperature: 20–22° C.

| Results: Second Series (n = 4) Prewash Compositions | | | | | |
|---|---|---|---|---|---|
| Soil/Fabric | C | N | P | R | Example 5 |
| Sump Oil/Poly-cotton | 5 | 3.88 | 2.13 | 2.50 | 0.63 |
| Engine Grease/ Poly-cotton | 5 | 4.50 | 2.75 | 2.25 | 1.63 |
| Lipstick/ Poly-cotton | 5 | 3.50 | 2.25 | 1.88 | 1.50 |

Key: Pre-wash Compositions Used
C Rating standard for no stain removal (no prewash and not washed)
N No pre wash (washed control)
P Isoparaffin based trigger
Q Water based trigger
R Isoparaffin based aerosol
S White spirit based aerosol
T Water based protease enzyme pump spray
U Naphthene based trigger For the aerosols of the first series, samples were applied through a standard Delta MBU actuator with a 0.41 mm diameter orifice Brown Aqua Insert obtained from Precision Valve.

For the aerosols of the second series, samples were applied through an integrated actuator/overcap without an insert and with an orifice 0.85 mm in diameter obtained from Precision Valve.

Aerosol valves of the same specification were used in both comparisons for R, S, Example 1 and Example 5.

It was observed that the use of the integrated actuator/overcap delivered the composition faster to the surface as compared with the Delta actuator. This may mean that more propellant is retained with a subsequent more vigorous and longer lasting bubbling action.

In addition to outstanding cleaning performance for a water-based prewash cleaning composition, the compositions of this invention display a number of advantages over the prior art:

In assessing flammability, preferred compositions exhibit no burn back and do not self sustain burning. By contrast prior art hydrocarbon solvent based compositions usually self sustain burning. Further, when hydrocarbon propellant is used in combination with hydrocarbon solvent, the compositions usually burn back as well.

Compared with the prior art solvent-based compositions, there is a significant reduction in preferred compositions in volatile organic compounds (VOC's). This is of particular importance in terms of environmental considerations.

There is a saving in ingredient costs in preferred compositions that include ethanol as the water-miscible coupling agents as compared with conventional hydrocarbon, solvent-based compositions.

There is also a saving in ingredient costs by replacing a proportion of conventional hydrocarbons with water.

In preferred compositions a stable clear microemulsion of the hydrocarbon propellant is formed which obviates the need for shaking the aerosol before use.

The bubbling action on the surface provides a visual indication to consumers of the cleaning action of the compositions.

In preferred compositions the bubbling action is achieved in the presence of surfactants in a water-based composition without creating a foam cover.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A non-foaming textile cleaning composition in the form of an aerosol-containing oil-in-water emulsion comprising:

(a) 5 to 50% w/w in total amount of one or more hydrocarbon propellants, wherein the propellants substantially form a part of the oil phase when the composition is formulated;

(b) 5 to 25% w/w in total amount of a surfactant system consisting of anionic surfactants, nonionic surfactants and mixtures thereof;

(c) 0.5 to 30% w/w in total amount of one or more water-immiscible hydrocarbon solvents selected from the group consisting of liquid n-paraffins, liquid isoparaffins, cycloalkanes, kerosene, white spirit, toluene, benzene and xylene;

(d) 5 to 30% w/w in total amount of one or more water-miscible organic coupling agents selected from the group consisting of methanol, ethanol, n-propanol, isopropanol, n-butanol and isobutanol; and (e) 10 to 70% w/w of water;

in which, upon discharge of the composition to a surface, a sufficient amount of the propellant is retained in the emulsion such that the retained propellant boils to create a sustained bubbling action on the surface.

2. The cleaning composition according to claim 1 wherein the sustained bubbling action lasts for up to 15 seconds.

3. The cleaning composition according to claim 2 wherein the sustained bubbling action is followed by a continuous, less vigorous bubbling action for up to 1 minute or more.

4. The cleaning composition according to claim 2 wherein the sustained bubbling action lasts for at least 10 seconds.

5. The cleaning composition according to claim 1 wherein the concentration of the propellants is from 10 to 30% w/w.

6. The cleaning composition according to claim 1 wherein the propellant is selected from the group consisting of acetylene, methane, ethane, ethylene, propane, propene, n-butane, n-butene, iso-butane, iso-butene, pentane, pentene, iso-pentane, iso-pentene, and mixtures thereof.

7. The cleaning composition according to claim 6 wherein the propellant is selected from the group consisting of propane, n-butane, iso-butane, pentane, iso-pentane, and mixtures thereof.

8. The cleaning composition according to claim 7 wherein the propellant is selected from the group consisting of propane, n-butane, iso-butane, and mixtures thereof.

9. The cleaning composition according to claim 1 wherein the concentration of an individual surfactant in a mixture of more than one surfactant is from 0.1 to 5% w/w.

10. The cleaning composition according to claim 1 wherein a surfactant is a nonionic surfactant selected from the group consisting of sorbitan fatty acid ester ethoxylates, glycerol fatty acid ester ethoxylates, sorbitan fatty acid esters, glycerol fatty acid esters, coconut monoethanolamide ethoxylates, tall oil ethoxylates, polypropylene glycol ethoxylates, fatty acid alkanolamides, coconut mono- and diethanolamide, fatty alcohol ethoxylates and propoxylates, amine oxides, n-alkyl pyrrolidones, alkyl polysaccharides, sucrose esters, alkyl phenol ethoxylates, ethoxylated castor oil, fatty acid ethoxylates, fatty amine ethoxylates, and polyglycerol fatty acid esters.

11. The cleaning compositions according to claim 1 wherein a surfactant is an anionic surfactant selected from the group consisting of sodium lauryl ether sulfate, triethanolamine lauryl sulfate, magnesium lauryl sulfate, sulfosuccinate esters, ammonium lauryl sulfate, alkyl sulfonates, sodium lauryl sulfate, sodium alpha olefin sulfonates, alkyl sulfates, sulfated alcohol ethoxylates, sulfated alkyl phenol ethoxylates, sodium xylene sulfonate, alkylbenzene sulfonates, triethanolamine dodecylbenzene sulfonate, sodium dodecylbenzene sulfonate, calcium dodecylbenzene sulfonate, xylene sulfonic acid, dodecylbenzene sulfonic acid, N-alkoyl sarcosinates, sodium lauroyl sarcosinate, dialkylsulfosuccinates, N-alkoyl sarcosines, lauroyl sarcosine, alkyl ether carboxylates, and sodium-, potassium-, magnesium-, calcium-, alkanolamine- and amine-soaps.

12. The cleaning composition according to claim 1 comprising a mixture of nonionic and anionic surfactants.

13. The cleaning composition according to claim 1 wherein the concentration of the water-immiscible organic hydrocarbon solvents is from 2 to 20% w/w.

14. The cleaning composition according to claim 1 wherein the water-immiscible hydrocarbon solvents function to suppress generation of foam on discharge of the aerosol.

15. The cleaning composition according to claim 14 wherein the water-immiscible hydrocarbon solvents include liquid n-paraffins.

16. The cleaning composition according to claim 14 wherein the water-immiscible hydrocarbon solvents include liquid iso-paraffins.

17. The cleaning composition according to claim 14 wherein the water-immiscible hydrocarbon solvents include compounds selected from the group consisting of toluene, benzene, and xylene.

18. The cleaning composition according to claim 14 wherein the water-immiscible hydrocarbon solvents are selected from the group consisting of liquid n-paraffins and liquid iso-paraffins.

19. The cleaning composition according to claim 1 wherein the organic coupling agent is ethanol and/or isopropanol.

20. The cleaning composition according to claim 19 wherein the organic coupling agent is ethanol.

21. The cleaning composition according to claim 1 wherein the water-miscible organic coupling agents include glycols selected from the group consisting of propylene glycol, hexylene glycol and ethylene glycol.

22. The cleaning composition according to claim 1 wherein the water-miscible organic coupling agents include polyglycols.

23. The cleaning composition according to claim 1 wherein the water-miscible organic coupling agents include polyols selected from the group consisting of glycerol, sorbitol, pantaerythritol, and mannitol.

24. The cleaning composition according to claim 1 wherein the water-miscible organic coupling agents include acetone.

* * * * *